US010978232B2

(12) United States Patent
Schonlau et al.

(10) Patent No.: US 10,978,232 B2
(45) Date of Patent: Apr. 13, 2021

(54) ELECTROMAGNET AND METHOD OF MAKING THE ELECTROMAGNET

(71) Applicant: Thomas Magnete GmbH, Herdorf (DE)

(72) Inventors: Juergen Schonlau, Daaden (DE); Christoph Thomas, Daaden (DE); Christian Häberle, Siegen (DE); Sebastian Heinzel, Neunkirchen (DE); Marc Leinweber, Neunkirchen (DE); Michael Ermert, Kirburg (DE)

(73) Assignee: Thomas Magnete GmbH, Herdorf (DE)

( * ) Notice: Subject to any disclaimer, the term of this patent is extended or adjusted under 35 U.S.C. 154(b) by 128 days.

(21) Appl. No.: 15/903,637

(22) Filed: Feb. 23, 2018

(65) Prior Publication Data

US 2018/0247749 A1 Aug. 30, 2018

(30) Foreign Application Priority Data

Feb. 25, 2017 (DE) ..... 10 2017 001 841.3
Jan. 16, 2018 (DE) ..... 10 2018 000 269.2

(51) Int. Cl.

| | |
|---|---|
| ***H01F 7/08*** | (2006.01) |
| ***H01F 3/00*** | (2006.01) |
| ***H01F 5/02*** | (2006.01) |
| ***H01F 41/02*** | (2006.01) |
| ***H01F 7/16*** | (2006.01) |
| ***H01F 7/128*** | (2006.01) |
| ***H01F 7/127*** | (2006.01) |

(52) U.S. Cl.

CPC ..... *H01F 7/081* (2013.01); *H01F 3/00* (2013.01); *H01F 5/02* (2013.01); *H01F 7/127* (2013.01);

(Continued)

(58) Field of Classification Search

CPC .. H01F 2007/086; H01F 3/00; H01F 41/0266; H01F 5/02; H01F 7/081;

(Continued)

(56) References Cited

U.S. PATENT DOCUMENTS 2,909,713 A * 10/1959 Hambor ..... H01F 7/1607 335/255
3,994,382 A * 11/1976 McIntosh ..... B41J 2/285 400/124.17

(Continued)

FOREIGN PATENT DOCUMENTS

DE 60103199 T2 6/2005
DE 102005048732 A1 4/2007

(Continued)

OTHER PUBLICATIONS

Machine translation of DE102005049663 (Year: 2005).*

(Continued)

*Primary Examiner* — Bernard Rojas
(74) *Attorney, Agent, or Firm* — Harness, Dickey & Pierce, P.L.C.

(57) ABSTRACT

An electromagnet and method for producing the electromagnet. The electromagnet is intended to maintain pretensioning force of fastening by a force acting on a yoke over intended operating time under changing operating temperatures. The yoke encloses an armature that is provided with a flange, which conducts magnetic flux from a housing to the armature, the housing being connected on the one hand to a flange of the yoke and on the other hand to a core flange in a material-bonding manner by welding. The electromagnet can be used for actuation of valves, couplings or other electromechanical adjusting elements.

8 Claims, 1 Drawing Sheet

(52) U.S. Cl.
CPC ..... *H01F 7/128* (2013.01); *H01F 7/1607* (2013.01); *H01F 41/0266* (2013.01); *H01F 2007/085* (2013.01); *H01F 2007/086* (2013.01)

(58) Field of Classification Search
CPC .... H01F 2007/085; H01F 7/127; H01F 7/128; H01F 7/1607
See application file for complete search history.

(56) References Cited

U.S. PATENT DOCUMENTS

| | | | | |
|---|---|---|---|---|
| 6,225,886 | B1 * | 5/2001 | Kleinert | H01F 7/081 251/129.15 |
| 6,624,733 | B1 * | 9/2003 | Swenson, Jr. | H01F 7/06 336/192 |

FOREIGN PATENT DOCUMENTS

| | | | | |
|---|---|---|---|---|
| DE | 102005049663 | A1 | 4/2007 | |
| DE | 102012022254 | B3 | 3/2014 | |
| DE | 102013226619 | A1 | 6/2015 | |
| EP | 0935262 | A2 | 8/1999 | |
| WO | WO 2017032441 | A1 * | 3/2017 | H01F 7/128 |

OTHER PUBLICATIONS

Machine translation of WO-2017032441-A1 (Year: 2017).*
German Office Action dated Nov. 13, 2017 in corresponding German Application No. 10 2017 001 841.3.

* cited by examiner

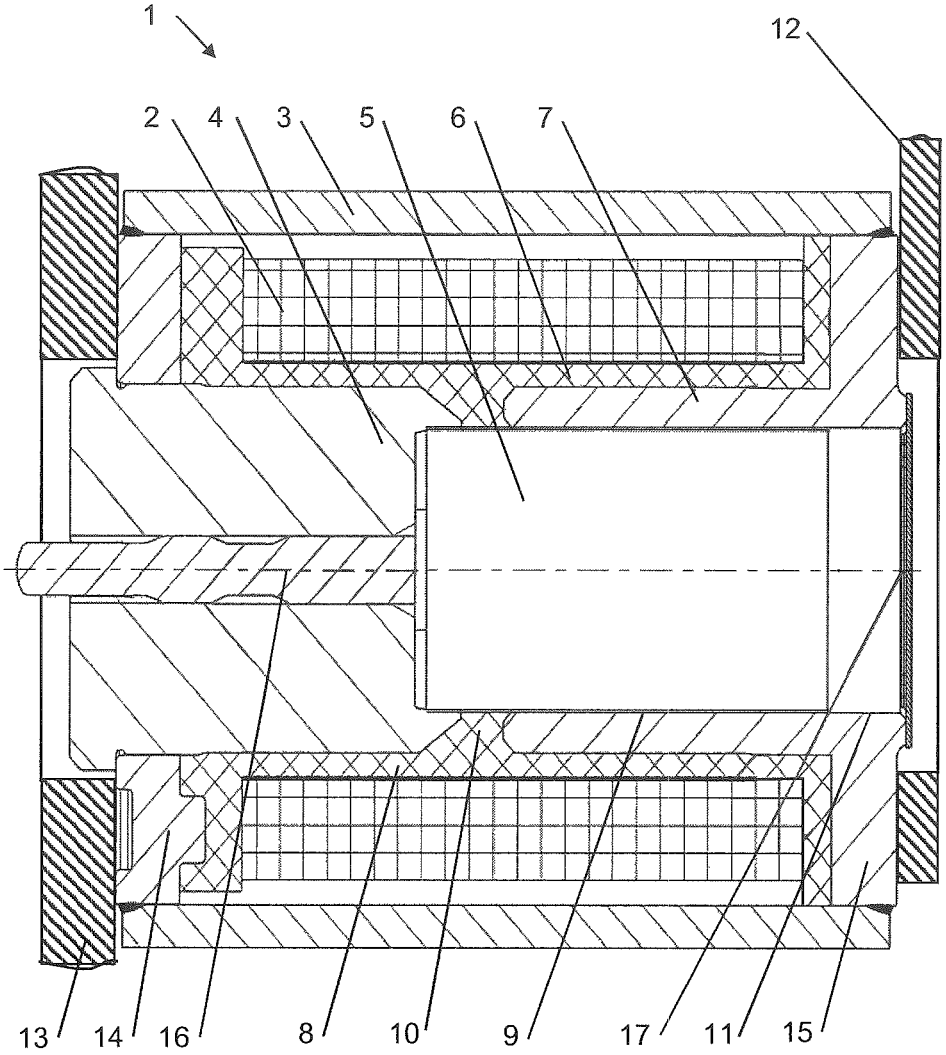
1
12
2
4
3
5
6
7
13
14
16
8
10
9
17
11
15

ELECTROMAGNET AND METHOD OF MAKING THE ELECTROMAGNET

CROSS-REFERENCE TO RELATED APPLICATIONS

This application claims the benefit and priority of: (1). German Application No. 102017001841.3 filed on Feb. 25, 2017; and (2). German Application No. 102018000269.2 filed on Jan. 16, 2018. The entire disclosures of each of the above applications are incorporated herein by reference.

FIELD

The present disclosure relates to an electromagnet and to a method for producing the same.

BACKGROUND

This section provides background information related to the present disclosure which is not necessarily prior art.

Electromagnets of the generic type described have long been known and are widely used. They are used for example for actuating valves, couplings or other electromechanical adjusting elements.

Documents DE 601 03 199 T2, DE 10 2005 049 663 DE 10 2012 022 254 B3, DE 10 2005 048 732 A1 and DE 10 2013 226 619 A1 disclose electromagnets of the generic type referred to that are used for actuating valves of vehicle transmissions.

Such an electromagnet consists at least of a magnetic coil wound on a coil core, a housing, a pole core, an armature, an armature rod and a yoke.

If such an electromagnet is fastened to a vehicle transmission in a low-cost way by being pressed against the transmission by means that act on the yoke from outside, the holding force is transmitted to the vehicle transmission by at least two different fluxes of force, to be specific an internal flux of force through the magnetic coil and a further flux of force through the housing.

The magnetic coil is encapsulated with a plastics compound, and in some embodiments this plastics compound also bridges the gap between the pole core and the yoke of the electromagnet. The plastic has the tendency to gradually deform plastically under load. As this happens, the pretensioning, and consequently the holding force, of the fastening is reduced if the flux of force through the magnetic coil makes up a predominant part of the overall flux of force with respect to the vehicle transmission. If the armature of the electromagnet is mounted in a pole tube, which supports the pole core against the yoke, only a small part of the flux of force referred to passes through the plastics compound, but if the axial gap between the pole core and the yoke is bridged only by the plastics compound, the plastics compound must transmit the flux of force.

SUMMARY

This section provides a general summary of the disclosure, and is not a comprehensive disclosure of its full scope or all of its features.

The electromagnet is intended to maintain the pretensioning force of the fastening by a force acting on the yoke over the intended operating time under the known changing operating temperatures.

The electromagnet includes at least of a magnetic coil wound on a coil core, a housing, a pole core, an armature, an armature rod and a yoke.

The coil core is produced by a joint encapsulation or overmolding of the yoke, the pole core and the core flange with a plastics compound. In this case, the axial intermediate space between the yoke and the pole core is also filled with the same plastics compound. It is in this way ensured that the primary air gap between the armature and the pole core is not magnetically short-circuited.

To achieve a high quality of the mounting of the armature, the coil core is produced with great accuracy in its inside diameter bearing the armature. This dispenses with the need for a pole shoe bearing the armature, but a very precise mounting of the armature is achieved nevertheless.

The fastening of the electromagnet to a transmission housing is performed here by a holder pressing onto the yoke flange and the core flange supporting the electromagnet on the housing of the vehicle transmission.

The yoke enclosing the armature is provided with a flange, which conducts the magnetic flux from the housing via a secondary air gap to the armature.

The housing is connected on the one hand to the flange of the yoke and on the other hand to the core flange in a material-bonding manner by welding. Welding achieves a great stiffness and resistance of the connection, which could not be achieved with a nonpositive connection under the operating conditions specified here.

After assembly, the initial flux of force passes from the holder to the transmission housing predominantly, that is to say in respect of over 50% of the overall flux of force, via the yoke flange, the housing and the core flange, because the stiffness of the flux-of-force path via the housing is accordingly made greater than the stiffness of the flux-of-force path via the yoke, the pole core and the plastics compound between the yoke and the pole core, the plastics compound referred to being responsible in particular for reducing the stiffness. After a relatively long operating time, for example 100 h, with the operationally customary changing forces of acceleration and temperatures, a still greater proportion of the flux of force passes via the yoke flange, the housing and the core flange, because the plastics compound gradually deforms plastically, but this shift in the flux of force cannot effectively reduce the pretensioning because of the small proportion of the flux of force via the magnetic coil.

For reasons of cost-effective production, the housing encloses the yoke flange and the core flange respectively on the outside, which makes it easier for the connections to be welded.

In this case, the housing is connected to the yoke flange and the core flange by laser welding.

The mounting of the armature is produced with great accuracy; the sliding properties are improved still further by the armature of the electromagnet being mounted in the yoke by means of a sliding film.

The method described below is used for producing the electromagnet, including at least the following steps:

a. encapsulating or overmolding the yoke, the yoke flange, the pole core and the core flange with a plastics compound for producing the coil core;
b. winding the magnetic coil around the coil core;
c. fitting the housing around the yoke flange, the magnetic coil and the core flange;
d. welding the housing to the yoke flange and the core flange;
e. fitting the sliding film into the yoke;

f. fitting the armature rod and the armature into the yoke; and g. welding the end plate onto the yoke or pressing the end plate into the yoke.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 shows the electromagnet according to the disclosure, and the fastening to the transmission housing.

Corresponding reference numerals indicate corresponding parts throughout the several views of the drawings.

DETAILED DESCRIPTION

Example embodiments will now be described more fully with reference to the accompanying drawings.

The electromagnet 1 according to FIG. 1 includes at least a magnetic coil 2 wound onto a coil core 6, a housing 3, a pole core 4, an armature 5, an armature rod 16 and a yoke 7.

In this case, the coil core 6 includes the yoke 7, the pole core 4 and a core flange 14.

The coil core 6 is produced by a joint encapsulation or overmolding of the yoke 7, the pole core 4 and the core flange 14 with a plastics compound 8.

In this case, the axial intermediate space 10 between the yoke 7 and the pole core 4 is also filled with the plastics compound 8.

The coil core 6 is produced with great accuracy in its inside diameter 11 bearing the armature 5.

The yoke 7 enclosing the armature 5 is provided with a flange 15, which conducts the magnetic flux from the housing 3 to the armature 5.

In this case, the housing 3 is connected on the one hand to the flange 15 of the yoke 7 and on the other hand to the core flange 14 in a material-bonding manner by welding.

The fastening of the electromagnet 1 to a transmission housing 13, which is only partially shown, is performed by a likewise only partially shown holder 12 pressing onto the yoke flange 15 and the core flange 14 supporting the electromagnet 1 on the transmission housing 13.

Advantageously, after assembly, the initial flux of force passes from the holder 12 to the transmission housing 13 predominantly over 50% via the yoke flange 15, the housing 3 and the core flange 14, because the stiffness of the flux-of-force path via the housing 3 is accordingly made greater than the stiffness of the flux-of-force path via the yoke 7, the pole core 4 and the plastics compound 8 between the yoke and the pole core, the plastics compound 8 referred to being responsible in particular for reducing the stiffness.

After an operating time of for example 100 h, a still greater proportion of the flux of force passes via the yoke flange 15, the housing 3 and the core flange 14, because the plastics compound 8 gradually deforms plastically.

Preferably, the housing 3 encloses the yoke flange 15 and the core flange 14 respectively on the outside.

It is likewise preferable that the housing 3 is connected to the yoke flange 15 and the core flange 14 by laser welding.

Advantageously, the armature 5 of the electromagnet is mounted in the yoke 7 by means of a sliding film 9.

LIST OF DESIGNATIONS

1. Electromagnet
2. Magnetic coil
3. Housing
4. Pole core
5. Armature
6. Coil core
7. Yoke
8. Plastics compound
9. Sliding film
10. Intermediate space
11. Inside diameter
12. Holder
13. Transmission housing
14. Core flange
15. Yoke flange
16. Armature rod
17. End plate The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for producing an electromagnet, that includes at least a magnetic coil wound onto a coil core, a housing, a pole core, an armature, an armature rod, and a yoke, wherein the coil core includes the yoke, the pole core, and a core flange, and wherein the yoke enclosing the armature is provided with a yoke flange, which conducts magnetic flux from the housing to the armature, comprising:

overmolding the yoke, the yoke flange, the pole core and the core flange with a plastics compound for producing the coil core;

winding the magnetic coil around the coil core;

fitting the housing around a first outer-most surface of the yoke flange, the magnetic coil, and the second outer-most surface of the core flange;

welding the housing to the first outer-most surface of the yoke flange and the second outer-most surface of the core flange to form a weld connection;

fitting a sliding film into the yoke;

fitting the armature rod and the armature into the yoke;

welding an end plate onto the yoke or pressing the end plate into the yoke; and pressing a holder onto the yoke flange and the core flange to cause a flux of a majority of a force to pass from the holder to a transmission housing via the yoke flange, the housing, and the core flange.

2. The method of claim 1, further comprising fastening the electromagnet to a vehicle transmission housing by engaging and pressing the holder directly against the yoke flange to directly engage and press the core flange against the vehicle transmission housing.

3. The method of claim 1, further comprising:

passing less than a majority of the flux of force through the plastics compound between the yoke and the pole core.

4. An electromagnet comprising:

a housing;

a coil core having a yoke, a pole core, and a core flange, the yoke, the pole core, and the core flange having a plastic overmold, the yoke and the pole core defining an axial intermediate space between the yoke and the pole core, the plastic overmold fills the axial intermediate space;

a magnetic coil wound on the coil core;

an armature;

an armature rod extending from the armature; and a welded connection;

a holder;

wherein the yoke flange has an outer yoke surface configured to be directly engaged by the holder to cause a flux of a majority of a force to pass from the holder to a transmission housing via the yoke flange, the housing, and the core flange;

wherein the yoke covers at least a portion of the armature and includes a yoke flange having a first outer radial surface, the yoke flange configured to conduct magnetic flux from the housing to the armature;

wherein the core flange has a second outer radial surface;

wherein the housing is connected to the first outer radial surface of the yoke flange and the second outer radial surface of the core flange by the welded connection;

wherein the housing encloses the yoke flange and the core flange about the first outer radial surface and the second outer radial surface.

5. The electromagnet of claim 4, wherein the armature is mounted in the yoke by a sliding film.

6. The electromagnet of claim 4, wherein fastening of the electromagnet to a transmission housing is by the holder pressing onto the yoke flange and the core flange supporting the electromagnet on the transmission housing.

7. The electromagnet of claim 4, wherein the core flange has an outer core surface configured to directly engage a vehicle transmission housing;

wherein the holder is configured to press against the outer yoke surface and press the outer core surface against the vehicle transmission housing.

8. The electromagnet of claim 4, wherein less than a majority of the flux of force is through the plastic overmold between the yoke and the pole core.

* * * * *